United States Patent [19]

Lawrence et al.

[11] Patent Number: 4,478,015

[45] Date of Patent: Oct. 23, 1984

[54] CABLE SLING ARRANGEMENT FOR PIVOTING A DRILLING MAST AND DRAWWORKS ELEVATOR TO A RAISED OR RECLINED POSITION IN RELATION TO A SUBSTRUCTURE SUPPORT AND METHOD OF CABLE SLING STRING UP

[76] Inventors: Larry K. Lawrence, 11219 Champion Woods Dr., Houston, Tex. 77375; John J. Grisaffi, 8005 Longridge, Houston, Tex. 77055

[21] Appl. No.: 414,968

[22] Filed: Sep. 7, 1982

[51] Int. Cl.[3] ..... E04H 12/34

[52] U.S. Cl. ..... 52/120; 52/116

[58] Field of Search ..... 52/116, 117, 118, 120

[56] References Cited

U.S. PATENT DOCUMENTS

| | | | |
|---|---|---|---|
| 2,695,081 | 11/1954 | Woolslayer | 52/120 |
| 2,706,540 | 4/1955 | Woolslayer | 52/120 |
| 3,271,915 | 9/1966 | Woolslayer | 52/120 |
| 3,803,780 | 4/1974 | Donnally | 52/120 |
| 4,221,088 | 9/1980 | Patterson | 52/120 |
| 4,269,009 | 5/1981 | Lawrence | 52/120 |
| 4,292,772 | 10/1981 | Borg | 52/120 |

FOREIGN PATENT DOCUMENTS

| | | | |
|---|---|---|---|
| 7314337 | 4/1974 | Netherlands | 52/120 |
| 990959 | 5/1965 | United Kingdom | 52/116 |

*Primary Examiner*—Henry E. Raduazo
*Attorney, Agent, or Firm*—Jack W. Hayden

[57] ABSTRACT

A drilling mast and drawworks elevator are pivotally secured to a substructure support with a frame secured to the support and extending upwardly between the drilling mast and elevator support. A cable on a rotatable drum on the drawworks elevator extends from a traveling block in the drilling mast, around the drilling mast crown block, to a drum on the drawworks elevator, and a hook is suspended by the traveling block in the drilling mast. Sheaves are mounted adjacent the upper end of the frame. Mast raising sheaves are mounted in the drilling mast as are deflection sheaves, and a slingline equalizer is connected with the hook means, with sheaves positioned thereon.

A pair of cable slings, each of which has one cable end connected to the drilling mast with the other cable end connected to the drawworks elevator, extends continuously and respectively from their respective connections with the drilling mast to extend over one of the frame sheaves, under one of the mast raising sheaves, around one of the deflection sheaves, around one of the sheaves in the equalizer means, then around another deflection sheave, underneath another mast raising sheave, over another frame sheave to extend to the connection on the drawworks elevator.

15 Claims, 8 Drawing Figures

CABLE SLING ARRANGEMENT FOR PIVOTING A DRILLING MAST AND DRAWWORKS ELEVATOR TO A RAISED OR RECLINED POSITION IN RELATION TO A SUBSTRUCTURE SUPPORT AND METHOD OF CABLE SLING STRING UP

SUMMARY OF THE INVENTION

Various cable sling and stringing arrangements have been provided for erecting and lowering drilling masts and drawworks elevators relative to a substructure support. The single slingline and stringing arrangements of the prior art generally require approximately 100' of travel of the traveling block to raise or erect the drilling mast from a horizontal to a vertical position. The clear height of a normal low lift, high floor drilling mast is such that it will not accommodate sufficient vertical movement of the traveling block to enable the drilling mast to be raised from a lowered to an erect position and to thereafter enable the drawworks elevator to be raised from a lowered to an erect position adjacent the erect drilling mast without interrupting the raising operations between the raising of the drilling mast and the drawworks elevator so that structure may be shifted, or to disconnect and rearrange the slingline so that the remaining lowered drilling mast or drawworks elevator, whichever the case, may thereupon be elevated to an erect position.

From the foregoing, it can be appreciated that the pivoting of the drilling mast and drawworks elevator from a horizontal position on a substructure support on which they are pivotally connected to an elevated, erect position has in most instances been effected by two separate string ups of the slingline each time the mast and drilling rig are positioned at a well location. That is, a separate string up is provided for elevating the mast, and then a separate string up is provided for the drawworks elevator.

Also conventional state of the art slingline arrangements employ one sheave over which the slingline passes from one side of the mast to the other side, but if such arrangement were employed to elevate the drawworks elevator as contemplated by the present invention, the tension on one end of the single slingline may differ from that on the other end, and an unequal pull might result. This would effect unequal loading on each side of the drawworks elevator which would cause it to tilt or skew in an undesirable manner so that elevation of the drawworks elevator from a horizontal to an erect position with conventional single slingline arrangements may not be practically accomplished.

Elevation of low lift, high floor drilling masts and drawworks elevators by the prior art single slingline arrangements require that the slinglines be strung up and then disconnected at each well location, and further require at least two string ups for each well location, one for the drilling mast and a separate additional string up for the drawworks elevator as hereinabove noted.

United States Patent No. 4,269,009 illustrates one such cable sling arrangement for elevating a drilling mast and a drawworks elevator on a substructure support. This patent illustrates a typical two step restringing operation of the slingline, one for elevating the drilling mast, and a separate restringing operation before initiating raising of the drawworks elevator. Also, after raising the mast, the slingline must be restrung to the drawworks elevator and a heavy lifting arm moved to a different position for elevation of the drawworks elevator. Due to the height and weight requirement of this operation, a crane would be required.

United States Patent No. 3,228,151 illustrates another cable sling arrangement for raising and lowering a drilling mast and a drawworks elevator pivotally connected to a substructure support.

In using the slingline arrangement of United States Patent No. 3,228,151, it is necessary that the drilling mast be heavier than the drawworks elevator in order that the drawworks elevator may be first raised to an elevated position. This structure would require that the drilling mast be structured so that it might not be readily transported over roadways within the legal load or other limits. Further, the above mentioned arrangement requires the use of a crane at the drilling location to unload the drilling mast and drawworks elevator to assist in properly positioning it on the substructure support.

The present invention overcomes all of the above disadvantages of state of the art slingline arrangements in that it enables a low lift, high floor drilling mast and a drawworks elevator which are pivotally supported on a substructure support to be elevated to an erect position without necessarily interrupting or stopping the erecting operations after either the drilling mast or drawworks elevator have been erected to change slingline positions or structure. Further, the present invention accomplishes the elevation of the drilling mast and drawworks with a single slingline string up which may be permanently retained in position from one well location to the next location with the exception of disconnecting one end of the slingline arrangement from the drawworks elevator.

The present invention also provides a slingline arrangement to inhibit skewing or canting of the drawworks elevator as it is elevated.

Another object of the present invention is to employ two separate continuous slinglines each of which are connected adjacent spaced sides of the drilling mast at one end and are connected adjacent spaced sides of the drawworks elevator at the other cable end. Each cable slingline is supported between its connected ends by sheave means mounted on frame means positioned between the mast and drawworks, mast raising sheave means positioned on the drilling mast, deflection sheave means mounted on the drilling mast and with each cable extending, respectively, around a separate slingline equalizer sheave carried by the traveling block in the drilling mast.

A further object of the present invention is to provide a slingline arrangement wherein each two foot movement of the slingline results in one foot of vertical travel of the slingline equalizer in the drilling mast.

Yet a further object of the present invention is that after each of the separate continuous slinglines have been strung up in the drilling mast, they need not thereafter be unstrung except for normal maintenance, but may be moved with the drilling mast from well location to well location.

Still another object of the present invention is to provide a slingline arrangement for elevating a low lift, high floor drilling mast and drawworks elevator which employs only one single string up at each well location.

Yet a further object of the present invention is to provide a slingline arrangement for erecting a low lift, high floor drilling mast and drawworks elevator wherein the drilling mast and drawworks elevator can be unloaded onto the substructure support on the ground by using a gin pole and truck winch to unload the drilling mast sections and drawworks from a vehicle onto the substructure support and drawworks elevator. In other words, it may be pulled directly off a truckbed or trailer right into position on the substructure support.

Accordingly, an object of the present invention is to provide an arrangement to enable a drilling mast and drawworks elevator to be transported from one location to another location over an ordinary roadway within the legal load and other legal limits. Further, the drilling mast and elevator can be loaded off the vehicle onto the substructure support merely by the use of a gin pole and winch truck, thus eliminating the use of a crane at the drilling location.

Another object of the present arrangement is that after the drilling mast and drawworks elevator are assembled on the substructure support in down position, it is not necessary to move any structure or any cables during the erection of the mast and drawworks elevator, or during the subsequent lowering thereof after drilling operations have been completed.

Still a further object of the present invention is to provide a cable arrangement for raising and lowering a drilling mast and drawworks elevator wherein the cable arrangement may be maintained in position during shipment of the mast and drawworks elevator from one drilling location to another.

The slingline arrangement of the present invention enables the cables to equalize equally, and they are arranged in relation to the drilling mast and drawworks elevator to reduce, if not substantially eliminate, unequal loading of the drawworks elevator and drilling mast which causes canting or racking during erection or during lowering from an erected position.

Also, due to the slingline reduction ratio, the mast vertical height on a high floor, deep drilling rig is minimized due to reduced slingline equalizer travel during raising operations.

Further, existing rigs can be modified for use of the present invention.

Other objects and advantages of the present invention will become apparent from a consideration of the following drawings and description.

DESCRIPTION OF THE PREFERRED EMBODIMENT

Figure 1:
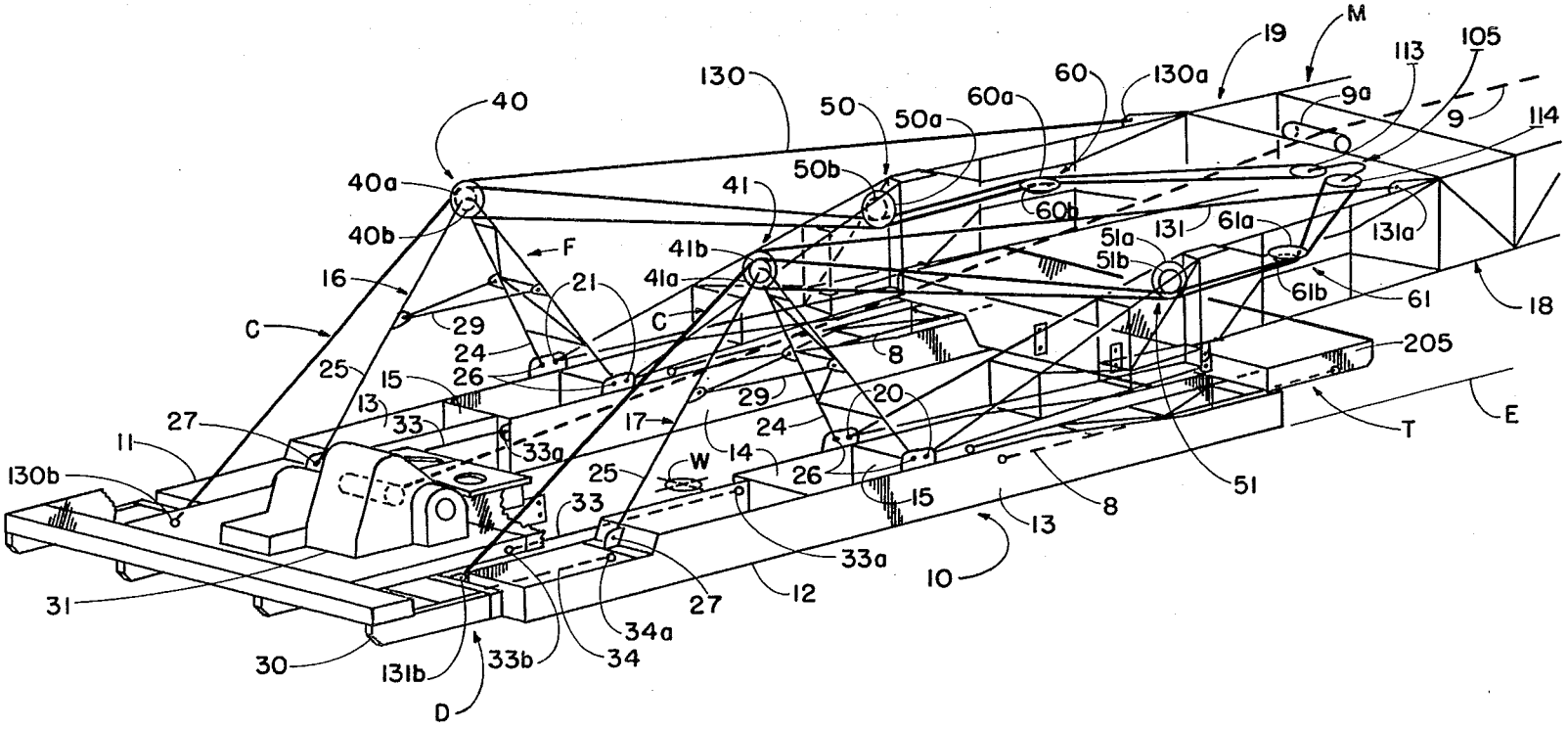
FIG. 1 is a schematic isometric view illustrating a drilling mast, drawworks elevator with drawworks thereon in lowered relation to a pair of substructure supports on which they are pivotally mounted with an A-frame extending upwardly from the substructure support between the lowered drilling mast and drawworks elevator, the cable sling arrangement and the cable extending from the drum on the drawworks to the crown block as illustrated in dotted line.
Figures 2, 2A, 2B, 2C, 2D:
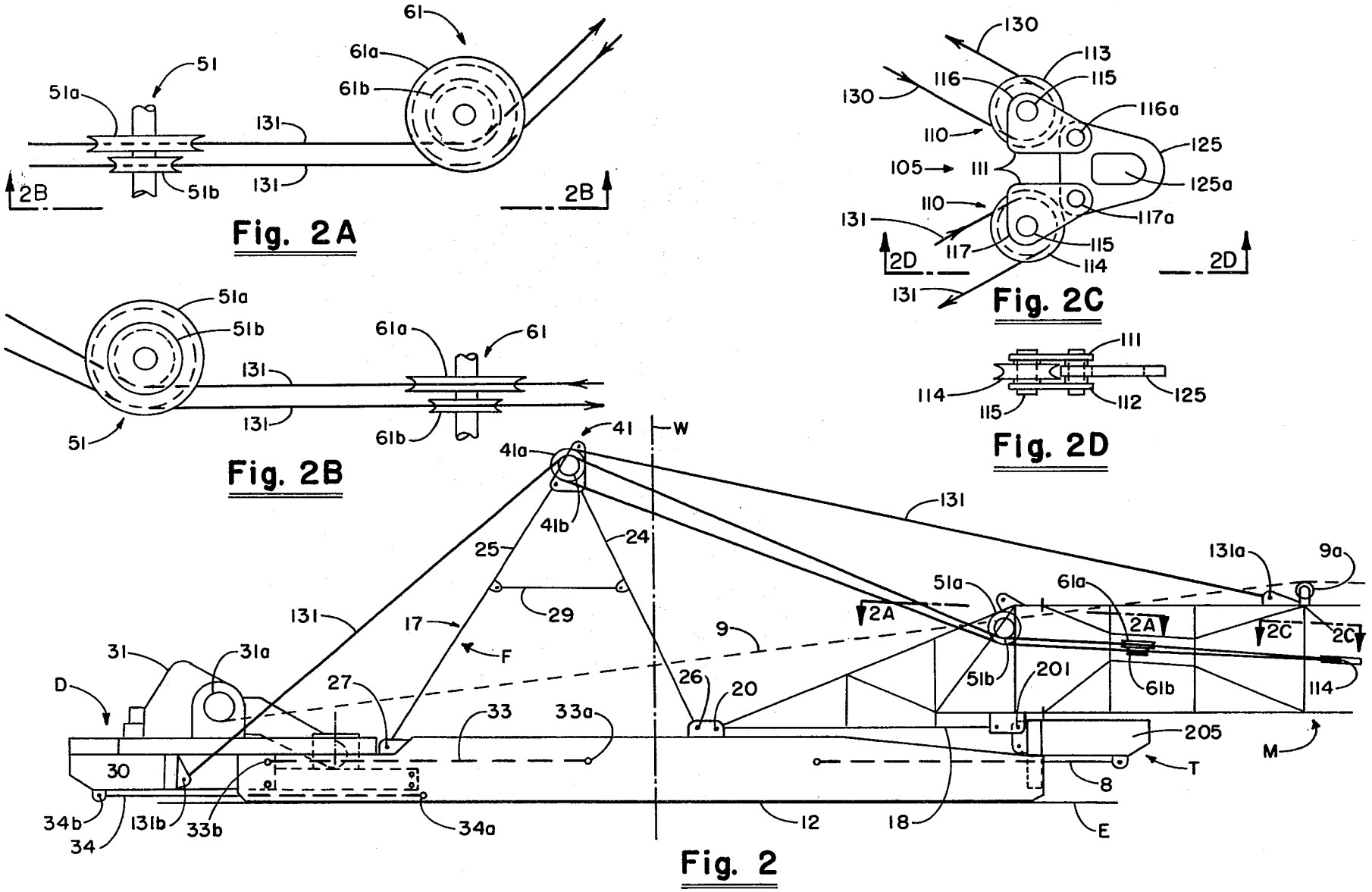
FIG. 2 is a side view illustrating a drawworks elevator, drawworks and drilling mast pivotally secured to a substructure support with frame means in the form of an A-frame therebetween and the cable sling arrangement of the present invention for elevating and lowering the drilling mast and drawworks elevator.
FIG. 2A is a partial plan view on the line 2A—2A of FIG. 2 illustrating a preferred arrangement of the mast raising sheaves and deflection sheaves for each mast leg.
FIG. 2B is a side view on the line 2B—2B of FIG. 2A.
FIG. 2C is a plan view on the line 2C—2C of FIG. 2 illustrating an arrangement of the slingline equalizer means.
FIG. 2D is a side view on the line 2D—2D of FIG. 2C.

Attention is first directed to FIG. 1 of the drawings wherein a substructure support is referred to generally by the numeral 10 and is shown as including a pair of longitudinally extending box members 11 and 12 for resting on the earth's surface E at a drilling location. The box members include the longitudinally extending members 13 and 14 which are secured together in spaced relation by the laterally extending braces 15 secured therebetween by any suitable means such as welding or the like. The substructure supports 11 and 12 are positioned on the earth's surface E in relation to the well location to be drilled represented by the letter W as shown in FIGS. 1 and 2 so that the well location is positioned therebetween.

Figure 3:
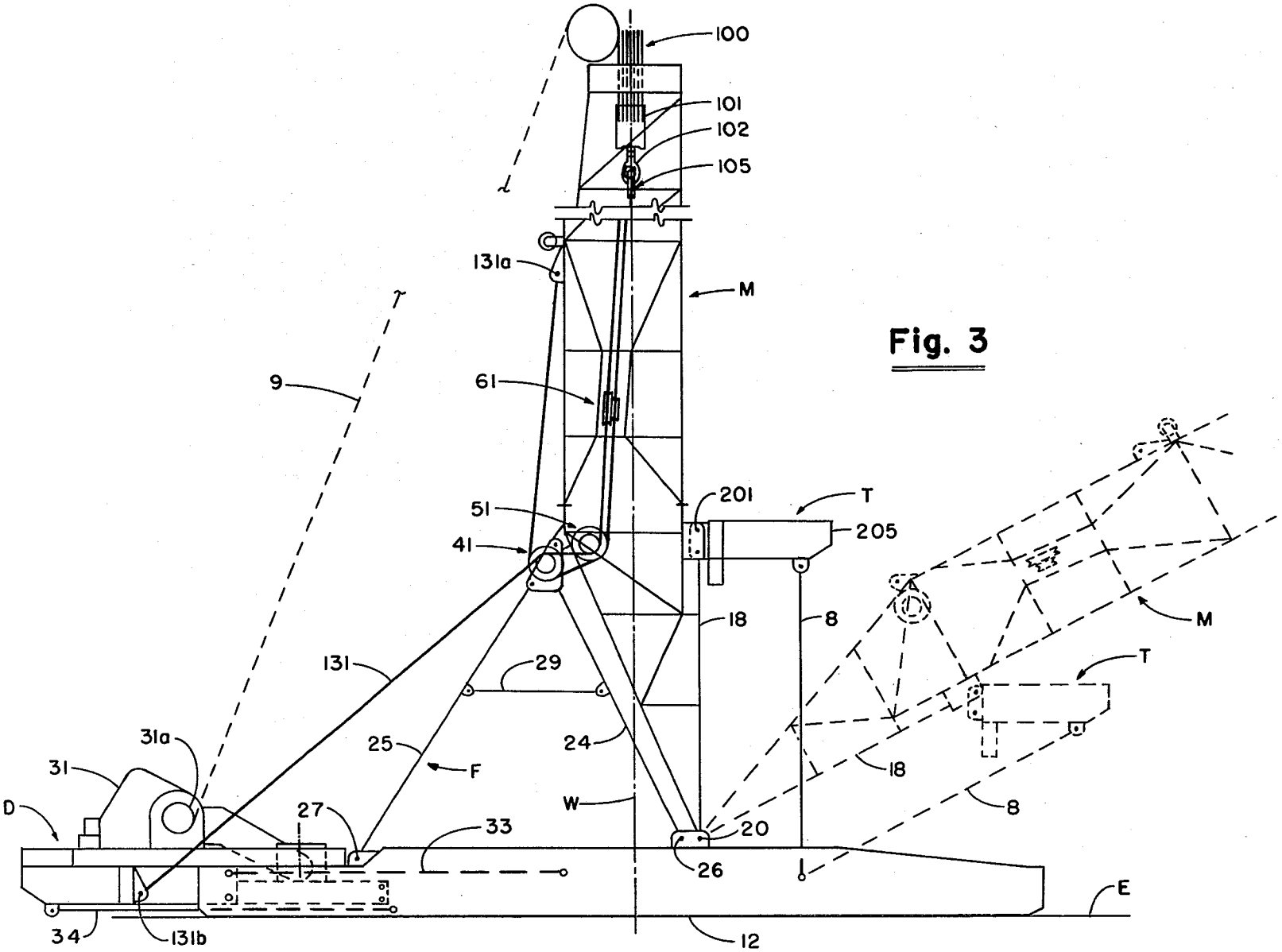
FIG. 3 is a side view of the substructure support, drilling mast and drawworks elevator showing in dotted line the position of the drilling mast and the setback associated therewith in partially elevated position and illustrating in full line view the mast in final erect position with the cable extending from the drawworks drum over the crown block on the top of the drilling mast and then to the traveling block which has the hook means thereon for supporting the slingline equalizer.

A drilling mast represented generally by the letter M includes the laterally spaced, longitudinally extending legs 18 and 19, the lower portion of which are illustrated in FIG. 1 of the drawings. The lower end of each of the legs 18 and 19 is pivotally pinned at 20 and 21, respectively, to the substructure supports 11 and 12 in a manner well known and as schematically illustrated in the drawings. A setback tower T is provided with a pair of laterally spaced, longitudinally extending legs 8, one end of each being pivotally pinned at its lower end to the substructure supports 11 and 12, respectively, with the other upper end of each being pivotally connected to the setback tower T, deck 205 as shown. The sides of the deck of floor 205 are respectively pivotally secured to the mast legs 18 and 19 by pins 201 in a manner well known in the art, and as illustrated in FIGS. 2 and 3.

Suitable frame means represented generally by the letter F and shown as being in the form of an "A" frame having laterally spaced members 16 and 17 that are mounted on box members 11 and 12 between the mast M and drawworks support D as shown. Each member 16 and 17 includes legs 24 and 25 which are pinned at their lower ends as illustrated at 26 and 27 on each of the laterally spaced substructure box supports 11 and 12 as illustrated in the drawings. Each of the legs 24 and 25 extends upwardly and inwardly to provide an inclined relationship and suitable bracing 29 extends therebetween. The legs 24 and 25 of each member are secured together at their upper ends and are spaced and arranged in any suitable manner as illustrated to provide lateral stability.

A drawworks elevator represented generally by the letter D includes a platform 30 for receiving a drawworks 31 thereon. Supports 33 and 34 are pivotally secured at one of their ends and extend longitudinally from opposite ends of the platform 30 illustrated in FIG. 2 at 33*b* and 34*b* and adjacent each side of the platform. The supports 33 and 34 are pivotally secured at their other end as illustrated at 33*a* and 34*a* to each of the structure members 11 and 12.

The pivotal arrangement of the drilling mast M, setback tower T and drawworks elevator D on substructure supports is well known and no further explanation is deemed necessary.

Figure 4:
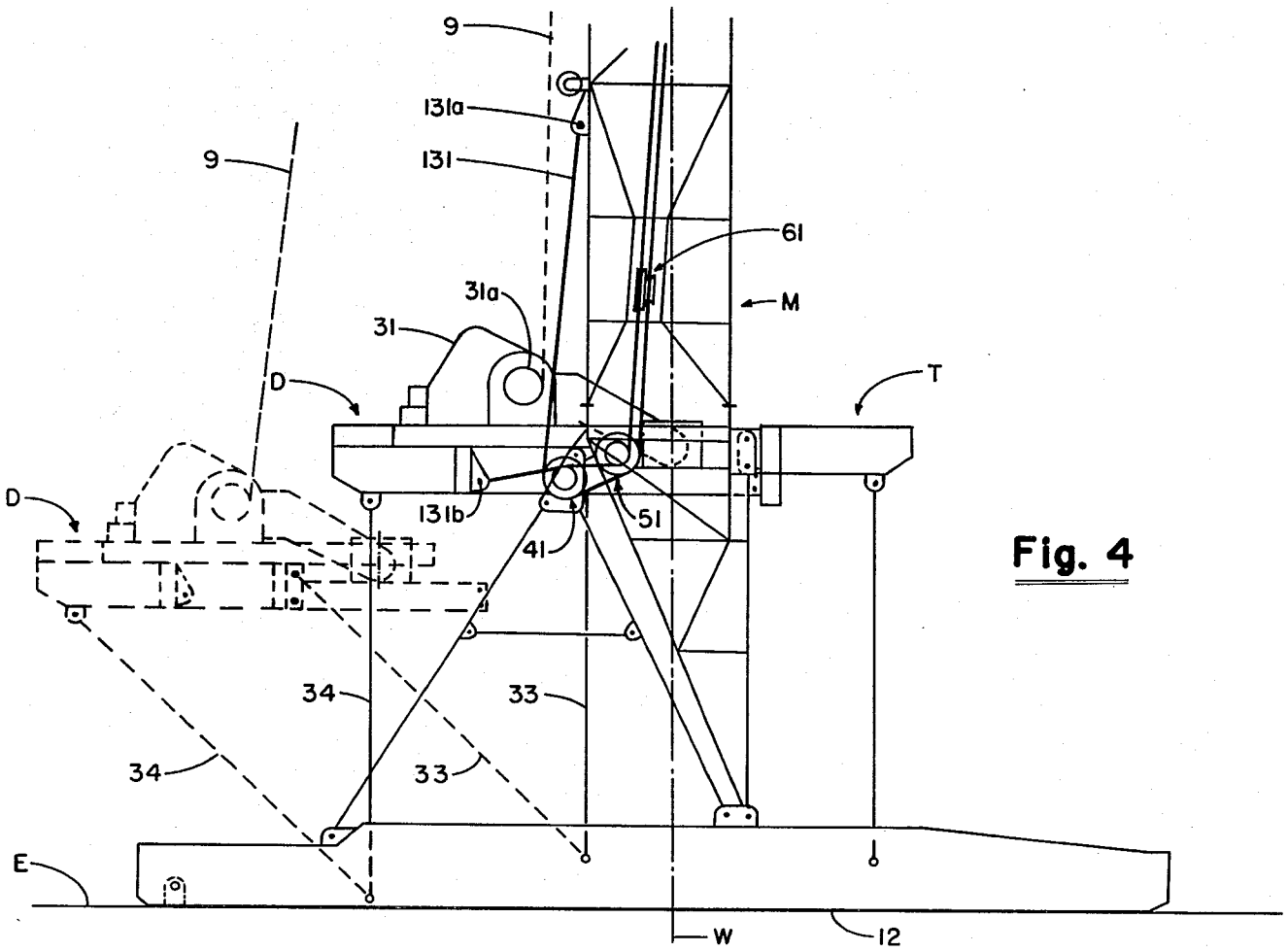
FIG. 4 is a side view similar to FIG. 3 and showing in dotted line the drawworks elevator and drawworks thereon partially elevated and in full line the final erect position of the drawworks elevator and the drawworks adjacent the erect drilling mast.

The pivotal arrangement of the mast M, drawworks elevator D and tower T enables the mast M, drawworks elevator D and tower T to be elevated from a reclined position on the substructure members 11 and 12 to be raised, or erect, position as illustrated in FIG. 4 of the drawings to accommodate drilling operations and then to be lowered back to a reclined position after drilling operations have been completed as will be described in greater detail hereinafter.

The frame means F is provided with sheave means 40 and 41, and the mast M is provided with mast raising sheave means 50 and 51, as well as deflection sheave means 60 and 61. The sheave means are positioned on the frame means and mast during fabrication.

As illustrated in FIG. 3 of the drawings, the upper end of the drilling mast M is provided with a crown block represented generally by the numeral 100. The drawworks 31 is provided with a drum 31*a* on which is wound a cable 9, commonly referred to as the fast line, which extends from the drum 31*a* over suitable roller means 9*a* and over the crown block 100. The crown block 100 comprises a plurality of sheaves arranged in a manner well known in the art, and the cable 9 extends around the sheaves as schematically illustrated in FIG. 3 and extends down to sheaves in a traveling block illustrated at 101 in FIG. 3. A hook 102 is suspended from the traveling block 101 and supports a slingline equalizer means 105. When the cable 9 is reeled in on the drawworks drum, the traveling block 101, hook 102 and slingline equalizer 105 move upwardly toward the crown block 100. When the cable 9 is unwound from drum 31*a*, the reverse of the foregoing occurs.

The slingline equalizer means 105 is better illustrated in FIGS. 2C and 2D of the drawings. The slingline equalizer means there illustrated includes housing means referred to by the numeral 110. The housing means 110 includes a pair of generally parallel, laterally spaced support means 111 and 112 which may be formed in any manner. As illustrated, it will be noted that the members 111 and 112 are formed of platelike material which is for purposes of illustration only. The support members 111, 112 are configured so as to rotatably support therebetween a pair of sheaves 113 as 114 in any suitable relationship. For example, the drawings illustrate the sheaves 113, 114 in laterally spaced edge to edge relation; however, it can be appreciated that they may be supported in parallel, vertical relation. The sheaves 113, 114 are shown as being rotatably mounted on suitable shafts 115 which extend through the support members 111 and 112 and are retained in position relative to the members 111, 112 by any suitable means.

It will be noted that the housing means 110 includes a first pair 116 and a second pair 117 of laterally spaced, generally parallel support members 111 and 112. Each pair of support members 111 and 112 is removably secured to a yoke 125 by suitable pin means 116*a* and 117*a*. This enables each sheave 113 and 114 to be removed from the slingline equalizer 105 with its respective slingline cable 130 and 131, as described herein.

The yoke 125 is secured with the housing means 110 of the slingline equalizer means 105 by any suitable means so as to secure the sheaves 113 and 114 in spaced relation and to maintain them in spaced relation and independently rotatable. The hook means 102 carried by the traveling block 101 may be engaged with the opening 125*a* of the yoke 125 during operation of the present invention.

Continuous cable slingline means represented by the letter C and shown in bold line in FIG. 1 include a pair of cables 130 and 131. Each cable 130, 131 is connected at one of their respective ends to one of the drilling mast legs 19 and 18, respectively, as illustrated at 130*a* and 131*a*. The other cable end is connected to the drawworks elevator platform of support 30 as illustated at 130*b* and 131*b*, respectively. The cable 130 extends from its connection 130*a* on drilling mast leg 19 over the frame sheave means 40, under mast raising sheave means 50, around deflection sheave means 60 and the sheave 113 in the slingline equalizer means 105 as illustrated in FIG. 1 of the drawings. The continuous cable 130 then continues to extend back around the deflection sheave means 60 under the mast raising sheave means 50 over the frame sheave means 40 and then extends to its connection 130*b* on the drawworks elevator support or platform 30 as illustrated in FIG. 1 of the drawings. It will be noted that the sheave means 40, 50 and 60 are generally aligned with leg 19. Similarly, the cable 131 extends from its connection 131*a* mast leg 18 over frame sheave means 41, under drilling mast raising sheave means 51, around deflection sheave means 61 and sheave 114 in slingline equalizer 105. It then continues around deflection sheave means 61, under mast raising sheave means 51, over frame sheave means 41 to its connection 131*b* on drawworks elevator D. The sheave means 41, 51 and 61 are preferably generally aligned longitudinally with leg 18.

More specifically, the frame sheave means 40 and 41 are mounted adjacent the upper ends of members 16 and 17, respectively, and are thus laterally spaced relative to each other adjacent the upper end of the frame means F and are axially aligned. Frame sheave means 40 includes a first sheave 40*a* and a second sheave 40*b* which are rotatably supported in any manner for independent rotation relative to each other; frame sheave means 41 includes a first sheave 41*a* and a second sheave 41*b* which are also mounted for independent rotation relative to each other.

Similarly, the mast raising sheave means 50, 51 are axially aligned and are mounted in laterally spaced relation in the legs 19, 18, respectively, of the drilling mast M, and each drilling mast sheave means 50, 51 includes a first sheave 50*a*, 51*a* and a second sheave 50*b*, 51*b*, respectively, each of which is mounted for rotation independently of the other sheave.

The deflection sheave means 60, 61 are axially aligned and are laterally spaced and supported by the drilling mast legs 19, 18, respectively, as shown in the drawings. Each deflection sheave means 60, 61 includes a first sheave 60*a*, 61*a* and a second sheave 60*b*, 61*b*, respectively, which are mounted for rotation independently of each other.

The sheave means 40, 41, 50, 51, 60 and 61 are thus mounted for independent rotation by any suitable means well known to those skilled in the art, and the details of such mounting is believed unnecessary to the present invention. Further, depending upon the relative arrangement and separation or spacing between the frame sheave means, raising sheave means and deflection sheave means, the pair of sheaves forming each of such sheave means may be of a different or the same diameter. The drawings illustrate the invention wherein the separation and arrangement of the sheaves is such that the first and second sheaves of each paired sheave means 40, 41, 50, 51, 60 and 61 are of a different diameter.

Specifically, it will be noted that the first sheave 40*a*, 41*a* of each of the paired sheave means 40, 41 is of a larger diameter than the second sheave 40*b*, 41*b*, respectively, of each of the sheave means 40, 41. The first sheave 50*a*, 51*a* of each of the sheave means 50, 51 is of a larger diameter than the second sheaves 50*b*, 51*b*, respectively, of each of the sheave means 50, 51. The first sheave 60*a*, 61*a* of each of the sheave means 60, 61 is of a larger diameter than the second sheaves 60*b*, 61*b*, respectively, of each of the sheave means 60, 61.

When the above described sheave arrangement is employed, the continuous cable 130 extends, as illustrated in FIG. 1, from its connection 130*a* on mast leg 19 over the first sheave 40*a*, underneath the first sheave 50*a*, around the second sheave 60*b*, then around the sheave 113 in the slingline equalizer means 105 and then back around the first sheave 60*a*, under the second sheave 50*b* and over the second sheave 40*b* to terminate at its other end at the connection as represented at 130*b* on the drawworks elevator D. Similarly, the cable 131 extends from its connection 131*a* on drilling mast leg 18 over the first sheave 41*a*, under the first sheave 51*a*, around the second sheave 61*b*, around the sheave 114 in the slingline equalizer means and then continues around the first sheave 61*a*, under second sheave 51*b* and over second sheave 41*b* to terminate at its other end at connection 131*b* on drawworks elevator D as illustrated in FIG. 1 of the drawings.

In the preferred embodiment, it is generally desired that the sheave means 40, 41, mast raising means 50, 51, and deflection means 60, 61 be generally aligned longitudinally, and to this end, the sheave means 40 mounted on frame member 16, and the sheave means 50 and 60 mounted on the drilling mast leg 19 are preferably mounted on the frame member and drilling mast leg to be generally longitudinally aligned. Similarly, the sheave means 41, 51 and 61 are preferably mounted on the frame member 17 and the drilling mast leg 18 to be generally aligned.

While it is believed that the operation of the present invention is apparent fromm the foregoing, it will be assumed that all of the components including the drilling mast, drawworks elevator support 30, drawworks 31 and frame F have been transported to a drilling location by suitable vehicular means. As noted previously, one of the advantages of the present invention is that the raising or elevating and lowering arrangement of the present invention enables all of the commponents to be loaded off the vehicle by a winch and gin pole and positioned adjacent the well location W. For example, the substructure support means 10 can be carried on a vehicle and then pulled off the vehicle by a winch line and positioned adjacent the well location W. Thereafter, the drawworks elevator D and drawworks may be pulled off the vehicle by a winch line and the drawworks elevator D thereon pivotally connected by means of the longitudinally extending legs 33 and 34 to the substructure support 10 and specifically the longitudinally extending base members 11 and 12 thereof.

Additionally, the drilling mast M and the setback tower T may be removed from the truck or vehicle in sections and then pivotally mounted on the longitudinally extending base members 11 and 12 at one side of the A-frame means F. During fabrication of the mast means M, the mast raising sheave means 50 and 51, and the deflection sheave means 60 and 61 are secured in position in relation to the respective mast legs 19 and 18. Similarly, when the leg 24 of the frame means F is fabricated, the sheave means 40 and 41, respectively, are secured therewith. Also, each slingline cable 130 and 131 is reeved with its respective frame sheave means 40, 41, mast sheave raising means 50, 51, deflection sheave means 60, 61, respectively, and is wound around its respective slingline equalizer sheave 113 and 114. The first cable ends 130*a* and 131*a* are secured to the respective mast legs 19 and 18.

During rig down and shipment of the drilling mast and frame, the frame legs 24 may be pivoted downwardly toward the respective mast legs 19 and 18 so that each of the frame means 40 and 41 is in close proximity to the mast raising sheave means 50 and 51, respectively, during transport to enable each cable 130, 131 to remain strung up or reeved with its respective sheave means 40, 41, 50, 51, 60, 61 and 113, 114 from one well location to the next. Of course, the second or other end 130*b* and 131*b* of each slingline means 130 and 131, respectively, is disconnected from the drawworks elevator D during shipment, and the portion of the cable between the cable ends 130*b*, 131*b* and the sheave means 40 and 41 on the frame legs 24 may be coiled and placed adjacent the reclined leg 24 during shipment.

The slingline equalizer means 105 may be separated if desired so that the sheave 113 is supported by its housing 110 to enable it to be positioned adjacent the leg 19 during shipment, and if desired, the sheave means 114 and its housing 110 may be positioned adjacent the leg 18 during shipment with their respective slingline cables 130 and 131, respectively, reeved thereon.

After the drilling mast and frame F have been removed from the transport vehicle at the well location and pivotally secured on their respective substructure supports, the legs 24 may be pivoted upwardly and secured with the legs 25 so that the frame F assumes an erect position between each leg 18 and 19 of the drilling mast M on the substructure supports 12 and 11, respectively, as illustrated in FIG. 1 of the drawings. Similarly, the end of the slingline cables 130 and 131 may be secured as illustrated at 130*b* and 131*b*, respectively, adjacent each side of the drawworks elevator D and as illustrated in FIG. 1 of the drawings. If the sheaves 113 and 114 have been removed from the yoke 125 of the slingline equalizer 105, they may be positioned therein as described hereinafter and the slingline equalizer means 105 engaged with the hook 102 of the traveling block 101 to effect elevation of the drilling mast and the drawworks elevator by the arrangement and method of the present invention.

It is to be specifically noted that once each of the separate continuous slingline cables 130 and 131 has been secured at one cable end with the drilling mast legs 19 and 18, respectively, and then reeved around their respective sheave means 40, 41, 50, 51, 60 and 61 as well as the equalizer sheave means 113 and 114, it is not thereafter necessary to disconnect or unreeve the slingline cable means at any time during the erecting operation, nor is it necessary to disconnect the cable means from the sheave means during shipment of the mast and drawworks from one well location to another. However, as previously noted, the cable ends 130*b* and 131*b* will be disconnected from the drawworks elevator D during shipment.

As the cable 9 is reeled in on the drum 31*a*, the traveling block 101 with hook 102 moves up in the reclined drilling mast M, and as this occurs, the slinglines 130, 131 will cause the legs 18, 19 of the drilling mast M to pivot upwardly due to the pivot connections 20 and 21 with the substructure support. This will move the mast M toward an erect position as illustrated in FIG. 3 until it assumes an erect position as illustrated in FIG. 3. As the mast M is elevated, the setback tower T is also pivoted upwardly to an erect position as shown in FIG. 3.

When the mast is raised to an upright position, it seats against the A-frame F in a manner well known in the art so as to prevent movement past the vertical position. It is also pinned to the A-frame when it is in an upright position in a manner well known in the art.

As previously noted, one of the advantages of the present invention is that an ordinary height, low lift high floor drilling mast M and a drawworks elevator may be elevated from a horizontal to an erect position with the dual sling, single string up arrangement of the present invention. In other words, after erection of the drilling mast M, it is not necessary to disconnect the separate continuous cable slings 130, 131 or other structure and to reconnect them in some different manner before the drawbacks can then be elevated to an erect position adjacent the erect drilling mast. As noted hereinbefore, one of the disadvantages of prior art slings is that the single sling arrangement requires so much travel of the traveling block in the drilling mast to elevate the mast to an erect position, there is not sufficient vertical clearance remaining between the traveling block and the crown block after the mast has been erected to enable the same slingline arrangement to then be employed to thereafter, and without substantial interruption, enable the drawworks to be elevated to an erect position adjacent the erect drilling mast.

The present invention overcomes this disadvantage in that it provides a slingline arrangement so that for each one foot of lift on the slingline equalizer 105, there is two feet of slingline lift. Thus, the present invention minimizes the height of a low lift, high floor drilling mast due to reduced slingline travel during the raising operation. Prior art systems operate on a one to one ratio, thus preventing a substantially continuous operation to first erect either the drilling mast or the drawworks and to thereafter elevate the other without first disconnecting and then reconnecting either or both the slingline or other structure.

The two separate continuous slingline arrangements of the present invention eliminate the two separate string ups generally required by the single sling cable arrangement of the prior art as described in detail hereinbefore. Further, the dual, separate, equal length continuous slingline arrangement of the present invention enables the drawworks to be elevated with greater assurance that there will be less skewing or canting of the drawworks elevator as it is elevated with the heavy drawworks 31 thereon since each slingline operates independently and may apply a more equal pull on each side of the drawworks elevator.

After the mast M has been erected by reeling cable 9 in on drum 31*a* and the mast pinned to the frame F, continued reeling in of the line 9 on the drawworks drum 31*a* will pivot the drawworks elevator D with support 30 and drawworks 31 thereon upwardly as represented in FIG. 4 until it also reaches an erect or elevated position as shown in FIG. 4. It is then secured to the setback tower T and frame F by means well known in the art.

After the drilling mast M and the drawworks elevator D have been raised to an elevated position and pinned in position, the equalizer means 105 may be removed from the hook 102, and the slingline equalizer means may be hung at any suitable location in the drilling mast M so as to be out of the way during drilling operations.

The drilling mast M and the drawworks elevator along with the drawworks are thus positioned vertically so that drilling operations may proceed in a manner well known in the art.

When it is desired to disassemble this arrangement after drilling operations have been completed, the slingline equalizer means 105 is then again secured in position with the hook 102. The slingline cable 130, 131, as previously noted, have remained connected with the sheave means 40, 41; 50, 51; 60, 61 and 113, 114, respectively. Tension is applied to the fast line 9 by reeling it in slightly on device 31*a*, and the pins are removed which retain the drawworks elevator D in elevated position. The drawworks elevator D is lowered from its raised or elevated position illustrated in FIG. 4 by gradually removing the tension from the fast line 9 so that the fast line 9 is gradually reeled out to enable the cables 130, 131 to lower the drawworks elevator D to its original lowered position. Thereafter, tension may again be applied to the fast line 9 and the pins removed from between the A-frame F and the drilling mast M whereupon line 9 is continued to be reeled out from the drum 31*a* on the lowered drawworks elevator D to enable the cables 130, 131 to function to lower the drilling mast M to its original reclined position.

In some instances, it may be desirable or necessary to pin the drawworks elevator D in its lowered position after it has been lowered from an elevated position and before lowering the drilling mast M, depending upon the weight of the drawworks 31.

In some instances, the drawworks elevator D may be pinned to the substructure supports 11 and 12 before elevating the mast. Similarly, if the drawworks elevator D is to be raised before the mast, the mast may be pinned to the substructure supports 11 and 12.

FIGS. 2A and 2B more clearly illustrate the relationship of the mast raising sheaves 50, 51 with their respective aligned deflector sheave means 60, 61. Although only the relationship of sheave means 51, 61 is shown, it can be appreciated that that relationship of sheave means 50 and 60 is the same. Specifically, FIGS. 2A and 2B represent only one side of the sheave means arrangement, namely, the mast raising sheave means 51 and deflection sheave means 61 arranged adjacent the longitudinally extending leg 18 of the drilling mast M. It will be noted that cable 131 extends under first sheave 51*a* and around second sheave 61*b* prior to engaging sheave 114 of slingline equalizer means 105; cable 131 extends from sheave 114 under first sheave 61*a* and under sheave 51*b*.

The foregoing disclosure and description of the invention are illustrative and explanatory thereof, and various changes in the size, shape and materials as well as in the details of the illustrated construction may be made without departing from the spirit of the invention.

We claim:

1. In a cable stringing arrangement for securing to a drilling mast and drawworks elevator for pivoting the drilling mast and drawworks elevator from a reclined position to an erect position in relation to a substructure support on which they are pivotally secured by reeling in a cable on a rotatable drum on the drawworks elevator, which cable extends from a traveling block in the drilling mast, over the drilling mast crown block, to the drum on the drawworks elevator, and wherein hook means are suspended by the traveling block, and wherein frame means between the drilling mast and drawworks elevator are secured to and extend upwardly from the substructure support, the invention comprising continuous cable sling means having one end connected to the drilling mast with the other cable end connected to the drawworks elevator and supported therebetween by sheave means mounted on each the frame means, drilling mast and hook means whereby reeling in the cable on the drawworks drum moves the drilling mast traveling block toward the drilling mast crown block which actuates the continuous cable sling means to erect the drilling mast and then the drawworks elevator.

2. In a cable stringing arrangement for securing to a drilling mast and drawworks elevator for pivoting the drilling mast and drawworks elevator from a reclined position to an erect position in relation to a substructure support on which they are pivotally secured by reeling in a cable on a rotatable drum on the drawworks elevator, which cable extends from a traveling block in the drilling mast, over the drilling mast crown block, to the drum on the drawworks elevator, and wherein hook means are suspended by the traveling block, and wherein frame means between the drilling mast and drawworks elevator are secured to and extend upwardly from the substructure support, the invention comprising continuous cable sling means having one end connected to the drilling mast and extending from such connection to ride and be supported on sheave means mounted on each the frame means, drilling mast and hook means with the other end of said continuous cable sling means secured to the drawworks elevator whereby reeling in the cable on the drawworks drum moves the drilling mast traveling block toward the drilling mast crown block which actuates the continuous cable sling means to erect the drilling mast and then the drawworks elevator.

3. In a cable sling arrangement for pivoting a drilling mast and drawworks elevator from a reclined position to an elevated position in relation to a substructure support on which they are pivotally secured by reeling in a cable on a rotatable drum on the drawworks elevator, which cable extends from a traveling block in the drilling mast, over the drilling mast crown block, to the drum on the drawworks elevator, and wherein hook means are suspended by the traveling block, the invention comprising:

a. frame means between the drilling mast and drawworks elevator and extending upwardly from the substructure support;

b. mast raising sheave means mounted in laterally spaced relation in the drilling mast, each of said mast raising sheave means including a first and second sheave;

c. deflection sheave means mounted in laterally spaced relation in the drilling mast, each of said deflection sheave means including a first and second sheave means;

d. slingline equalizer means for connecting with the hook means, said slingline means including a pair of laterally spaced sheaves;

e. laterally spaced frame sheave means mounted adjacent the upper end of said frame means, each of said frame sheave means including first and second sheaves; and f. continuous cable sling means including a pair of cables, each of which has one cable end connected to the drilling mast with the other cable end connected to the drawworks elevator; each cable extending respectively from its connection with the drilling mast to extend over said first sheave of said frame sheave means, under said first sheave of said mast raising sheave means, around said second sheave of said deflection sheave means, around one of the sheaves in said slingline equalizer means, and then around the first sheave of each of said deflection sheave means, underneath said second sheave of said mast raising sheave means, over said second sheave of said frame sheave means to extend to the connection on said elevator drawworks.

4. The arrangement of claim 3 wherein said first and second sheaves of each said raising and deflection sheave means are of a different diameter.

5. The arrangement of claims 1 or 2 wherein:

a. said frame means is an A-frame;

b. said frme sheave means are mounted in laterally spaced relation on said frame means;

c. said mast raising sheave means are mounted in laterally spaced relation and adjacent a side of the mast; and d. said deflection sheave means are mounted adjacent a side of the mast and in laterally spaced relation.

6. The arrangement of claim 3 wherein said slingling equalizer means includes:

a. housing means;

b. said housing means including a pair of laterally spaced, generally parallel support members;

c. means rotatably supporting said pair of sheaves in laterally spaced edge to edge relationship between said support members; and d. means to retain said support members in laterally spaced relation.

7. The invention of claim 6 including yoke means secured to said housing means for receiving the hook suspended by the traveling block.

8. The invention of claim 3 wherein said slingline equalizer means includes:

a. housing means;

b. said housing means includes a first pair and a second pair of laterally spaced, generally parallel support members which are spaced in edge to edge relation;

c. means rotatably supporting one of said pair of sheaves in each said first pair and second pair of support members; and d. yoke means secured to each of said first and second pair of support means for receiving the hook suspended by the traveling block.

9. The invention of claims 1 or 2 wherein said continuous cable sling means comprises a pair of independent cables.

10. The arrangement of claims 1 or 2 wherein said sheave means on the frame means and drilling mast means each comprise paired sheaves which are respectively laterally spaced and generally axially and longitudinally aligned relative to the substructure support.

11. The arrangement of claims 1 or 2 wherein said sheave means on the frame means and drilling mast means each comprise paired sheaves, with the sheaves of each pair being axially aligned, independently rotatable and of a different diameter.

12. The arrangement of claims 1 or 2 wherein said sheave means on the hook means comprise a pair of sheaves.

13. The arrangement of claims 1 or 2 wherein said continuous cable sling means comprises a pair of independent cable and wherein said sheave means on the hook means comprise a pair of sheaves for receiving said independent cables.

14. In a method of pivoting a drilling mast and drawworks elevator from a reclined position to an erect position in relation to a substructure support on which they are pivotally secured by reeling in a cable on a rotatable drum on the drawworks elevator, which cable extends from a traveling block in the drilling mast, over the drilling mast crown block, to the drum on the drawworks elevator, and wherein hook means are suspended by the traveling block, and wherein frame means between the drilling mast and drawworks elevator are secured to and extend upwardly from the substructure support, the steps comprising:

a. securing a first continuous cable means at one end adjacent a first side of the drilling mast;

b. supporting the first cable means on sheave means mounted on each the frame means, drilling mast and hook means;

c. securing the other end of the first continuous cable means adjacent a first side of the drawworks elevator;

d. securing a second continuous cable means at one end adjacent a second side of the drilling mast;

e. supporting the second cable means on sheave means mounted on each the frame means, drilling mast and hook means;

f. securing the other end of the second continuous cable means adjacent a second side of the drawworks elevator; and g. reeling in the cable on the drawworks drum to move the drilling mast traveling block toward the drilling mast crown block to actuate the first and second continuous cable means to erect the drilling mast and then the drawworks elevator.

15. In a method of stringing up cable sling means on a drilling mast and drawworks elevator secured by reeling in a cable on a rotatable drum on the drawworks elevator, which cable extends from a traveling block in the drilling mast, over the drilling mast crown block, to the drum on the drawworks elevator, and wherein hook means are suspended by the traveling block, and wherein frame means between the drilling mast and drawworks elevator are secured to and extend upwardly from the substructure support, comprising the steps of:

a. securing a first continuous cable means at one end adjacent a first side of the drilling mast;

b. supporting the first cable means on sheave means mounted on each the frame means, drilling mast and hook means;

c. securing the other end of the first continuous cable means adjacent a first side of the drawworks elevator;

d. securing a second continuous cable means at one end adjacent a second side of the drilling mast;

e. supporting the second cable means on sheave means mounted on each the frame means, drilling mast and hook means; and f. securing the other end of the second continuous cable means adjacent a second side of the drawworks elevator.

* * * * *